US012007127B2

(12) United States Patent
Brasuell et al.

(10) Patent No.: US 12,007,127 B2
(45) Date of Patent: Jun. 11, 2024

(54) AIR CONDITIONING COMPRESSOR SOUND ATTENUATION

(71) Applicant: Rheem Manufacturing Company, Atlanta, GA (US)

(72) Inventors: Derek Brasuell, Van Buren, AR (US); Paul McKim, Fort Smith, AR (US); Rick Robbins, Huntington, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 9 days.

(21) Appl. No.: 17/460,876

(22) Filed: Aug. 30, 2021

(65) Prior Publication Data

US 2021/0388996 A1 Dec. 16, 2021

Related U.S. Application Data

(63) Continuation of application No. 16/218,316, filed on Dec. 12, 2018, now Pat. No. 11,105,520.

(51) Int. Cl.
*F24F 1/12* (2011.01)
*F24F 13/24* (2006.01)

(52) U.S. Cl.
CPC ..... *F24F 1/12* (2013.01); *F24F 13/24* (2013.01); *F04B 2201/0804* (2013.01); *F24F 2013/242* (2013.01); *F24F 2013/247* (2013.01); *F25B 2500/12* (2013.01)

(58) Field of Classification Search
CPC ..... F04B 2201/0804; F25B 2500/12; F24F 13/24; F24F 2013/242; F24F 2013/247; B29C 44/12; B29C 33/68; B29C 44/3415
See application file for complete search history.

(56) References Cited

U.S. PATENT DOCUMENTS

| | | | | |
|---|---|---|---|---|
| 4,447,377 | A * | 5/1984 | Denton | B29C 44/1242 264/45.2 |
| 7,553,437 | B2 * | 6/2009 | Thompson | B29C 44/146 53/427 |
| 10,418,014 | B2 * | 9/2019 | Lowry | G10K 11/162 |
| 2005/0287007 | A1 * | 12/2005 | Leonhard | F04B 53/003 417/11 |
| 2006/0192033 | A1 * | 8/2006 | Dansizen | B05B 7/0408 239/433 |
| 2013/0156614 | A1 * | 6/2013 | Bonifas | F04B 39/0033 417/313 |

* cited by examiner

*Primary Examiner* — Connor J Tremarche
(74) *Attorney, Agent, or Firm* — Eversheds Sutherland (US) LLP

(57) ABSTRACT

A method of forming a sound attenuator around a compressor of an air conditioning system includes covering the compressor with a flexible protective cover and depositing a plurality of materials proximate an outer surface of the flexible protective cover such that at least some of the plurality of materials can chemically react to create a self-forming foam that abuts at least some of the flexible protective cover to thereby create the sound-attenuating structure around the compressor.

13 Claims, 6 Drawing Sheets

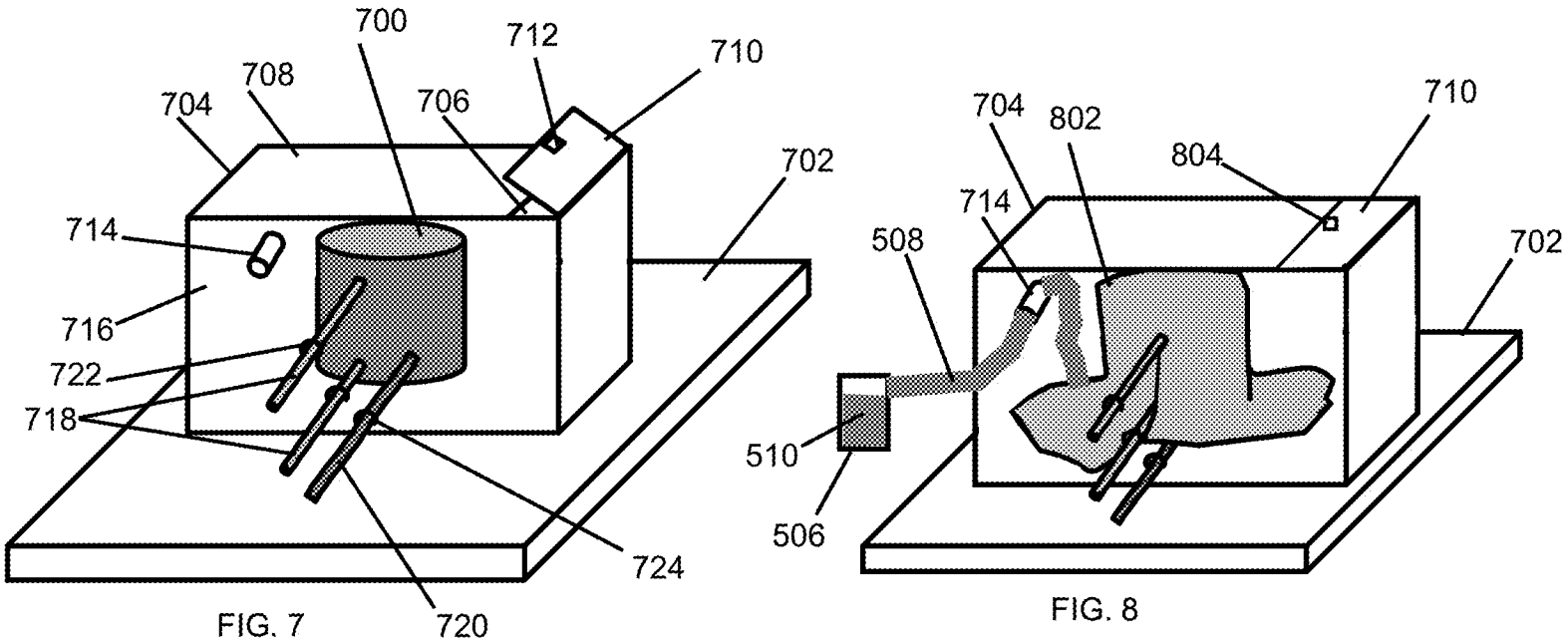
FIG. 7
FIG. 8
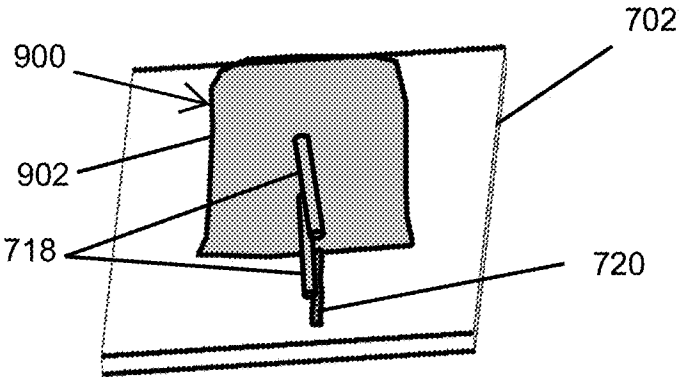
FIG. 9

AIR CONDITIONING COMPRESSOR SOUND ATTENUATION

CROSS REFERENCE TO RELATED APPLICATIONS

The present application is a continuation application of U.S. patent application Ser. No. 16/218,316, filed 12 Dec. 2018, the entire contents of which is incorporated herein by reference.

TECHNICAL FIELD

The present disclosure relates generally to air conditioners, and more particularly to attenuation of sound produced by compressors of air conditioning systems including air conditioners and heat pumps.

BACKGROUND

Air conditioning systems, such as air conditioners and heat pumps, typically include a compressor. A compressor plays an important role in an air conditioning system by compressing the refrigerant of the system, which results in the removal of heat from the refrigerant. An operating compressor of an air conditioning system typically produces a loud sound. During normal operations of an outdoor air conditioning unit, the compressor contributes a significant amount of the sound produced by the outdoor air conditioning unit. The loud sound produced by a compressor can be a source of annoyance and complaints. One approach to dampening the sound produced by a compressor is to cover the compressor with a sound blanket. However, a typical sound blanket fails to satisfactorily dampen the sound produced by a compressor at least partly because of the difficulty of adequately covering gaps and openings that allow the sound to escape. Further, a sound blanket that has multiple layers to dampen the sound from a compressor may be relatively expensive. Thus, a solution that enables adequate dampening of a compressor sound cost effectively may be desirable.

SUMMARY

The present disclosure relates generally to air conditioners, and more particularly to attenuation of sound produced by compressors of air conditioning systems including air conditioners and heat pumps. In some example embodiments, a method of forming a sound attenuator around a compressor of an air conditioning system includes providing a molding cover, positioning a compressor of an air conditioning system in a cavity of the molding cover, and placing a first material in the cavity of the molding cover. The method further includes placing a second material in contact with the first material in the cavity of the molding cover. The first material and the second material chemically react with each other to form a self-forming foam around the compressor.

In another example embodiment, a method of forming a sound attenuator around a compressor of an air conditioning system includes providing a molding cover, positioning a compressor of an air conditioning system in a cavity of the molding cover, and providing a liquid foam into the cavity of the molding cover, where the liquid foam forms a self-forming foam around the compressor.

In another example embodiment, a compressor assembly includes a compressor of an air conditioning system, a protective cover covering the compressor, and a self-forming foam formed around the compressor. The self-forming foam is separated from the compressor by the protective cover. The self-forming foam attenuates a sound produced by the compressor.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein:

FIG. 7 illustrates a compressor covered by a molding cover according to another example embodiment;

FIG. 8 illustrates a protective cover placed over the compressor of FIG. 7 according to an example embodiment;

FIG. 9 illustrates a side view of a compressor assembly including a self-forming foam formed around the compressor of FIG. 7 from a liquid foam material placed inside the molding cover according to an example embodiment;

Figure 2:
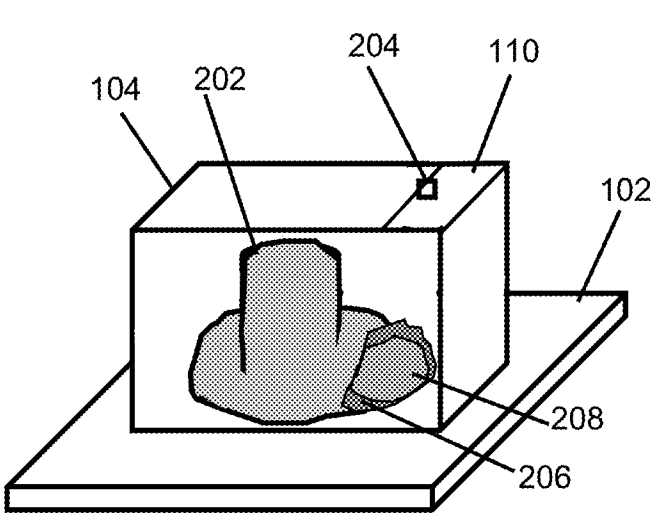
FIG. 2 illustrates a protective cover placed over the compressor of FIG. 1 according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

DETAILED DESCRIPTION

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Figure 1:
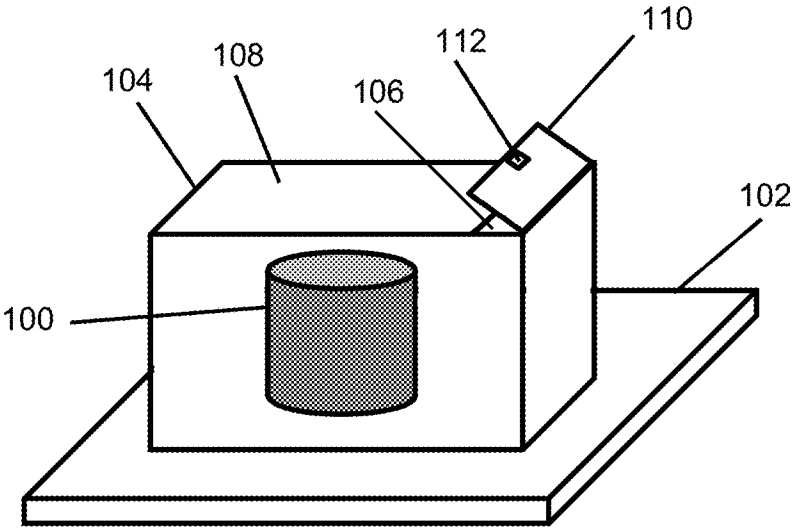
FIG. 1 illustrates a compressor covered by a molding cover according to an example embodiment.
Figure 3:
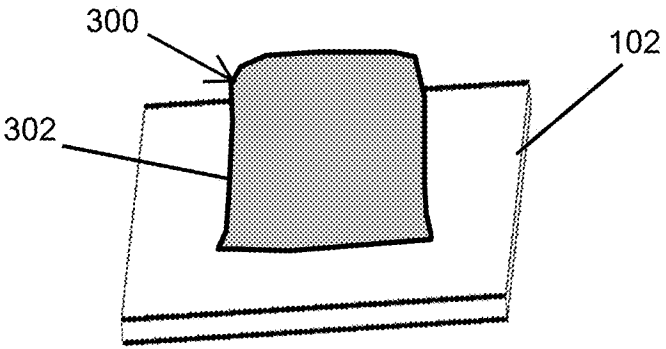
FIG. 3 illustrates a side view of a compressor assembly including a self-forming foam formed around the compressor of FIG. 1 from one or more materials placed inside the molding cover according to an example embodiment.

Turning now to the figures, particular example embodiments are described. FIG. 1 illustrates a compressor 100 covered by a molding cover 104 according to an example embodiment. FIG. 2 illustrates a protective cover 202 placed over the compressor 100 of FIG. 1 according to an example embodiment. FIG. 3 illustrates a side view of a compressor assembly 300 including a self-forming foam 302 formed around the compressor 100 of FIG. 1 from one or more materials placed inside the molding cover according to an example embodiment. In FIGS. 1 and 2, the front-facing wall of the molding cover 104 is shown as a transparent wall to more clearly show the cavity of the molding cover 104. The phrase "self-forming foam" as used throughout this specification refers generally to a foam that is formed around a compressor, such as the compressor 100 or other compressors described herein, as a result of a chemical reaction (s) of constituent material(s) at the compressor and/or as a result of a transformation(s) of a material, such as a liquid foam, into a solid foam at the compressor.

Referring to FIGS. 1-3, in some example embodiments, the compressor 100 may be placed on a platform 102. For example, the platform 102 may be a base structure of an outdoor air conditioning unit. The compressor 100 of an air conditioning system (e.g., the air condition system shown in FIG. 12) may be positioned in a cavity of the molding cover 104. For example, the molding cover 104 may be placed over the compressor 100, where, for example, the bottom side of the molding cover 104 is at least partially open.

In some example embodiments, the molding cover 104 includes an opening 106 and a door 110 that may be used to cover the opening 106. For example, the opening 106 may be formed on a top wall 108 of the molding cover 104. Alternatively, the opening 106 may be at a different location in the top wall 108 or another wall of the molding cover 104 without departing from the scope of this disclosure. The door 110 may include a latching mechanism 112 for keeping the door 110 latched to the top wall 108.

In some example embodiments, the latching mechanism 112 may be an opening or another structure to interface with a latching structure 204 attached to the top wall 108. The latching mechanism 112 and the latching structure 204 may operate to keep the door 110 latched such that the door closes the opening 106. In some alternative embodiments, the door 110 may be kept latched to the top wall 108 by other means as may be contemplated by those of ordinary skill in the art with the benefit of this disclosure.

In some example embodiments, the compressor 100 may be covered by the protective cover 202 as more clearly shown in FIG. 2. The protective cover 202 protects the compressor 100 from direct contact with the self-forming foam 302 or one or more materials that are used to form the self-forming foam 302. For example, the protective cover 202 may be a flexible cover that is placed over the compressor 100, for example, through the opening 106 before the opening is closed by the door 110. Alternatively, the protective cover 202 may be a flexible cover that is placed over the compressor 100 before the compressor 100 is positioned in the cavity of the molding cover 104. In some example embodiments, the protective cover 202 may be made from plastic. The molding cover 104 may be made from a suitable material such as one or more metals, wood, plastic, etc.

In some example embodiments, a material 206 that is used to form the self-forming foam 302 shown in FIG. 3 is placed in the cavity of the molding cover 104. For example, the material 206 may be placed in the cavity of the molding cover 104 through the opening 106. A material 208 that is used to form the self-forming foam 302 by interacting with the material 206 may be placed in the cavity of the molding cover 104, for example, through the opening 106. For example, the material 208 may be placed in contact with the material 206 such that the materials 206, 208 interact with each other to form the self-forming foam 302 around the compressor 100. The materials 206, 208 may be placed at least partially on the protective cover 202. One or both of the materials 206, 208 may be poured into the cavity of the molding cover 104, for example, through the opening 106. Alternatively, the containers of the materials 206, 208 may be opened or otherwise intentionally breached so that the materials 206, 208 start undergoing a chemical reaction with each other to form the self-forming foam 302 around the compressor 100.

In some example embodiments, the protective cover 202 may protect the compressor 100 from direct contact with the self-forming foam 302 or the materials 206, 208. For example, the protective cover 202 may be between the compressor 100 and the self-forming foam 302 such that the self-forming foam 302 is not in direct contact with the compressor 100. The protective cover 202 allows, for example, easier removal of the entire or parts of the self-forming foam 302 from the compressor 100 and may provide some protection of the ports of the compressor 100 from direct exposure to the materials 206, 208 and the self-forming foam 302.

In some example embodiments, the materials 206, 208 may be inside the protective cover 202 separated from the compressor 100 by the protective cover 202 itself. For example, the protective cover 202 may include compartments that keep the materials 206, 208 separated from each other until the separation is removed to allow the materials 206, 208 to interact chemically to form the self-forming foam 302. The protective cover 202 may be placed over the compressor 100 to cover the compressor 100 while the materials 206, 208 are inside the protective cover separated from each other. The protective cover 202 may protect the compressor 100 from direct contact with the self-forming foam 302 or the materials 206, 208.

In some alternative embodiments, the first material and the second material may be inside the protective cover separated from the compressor by the protective cover, where the compressor is covered by the protective cover while the first material and the second material are inside the protective cover. For example, the protective cover may include compartments that keep the first material and the second material separated from each other until the separation is removed to allow the first material and the second material to interact chemically to form the self-forming foam.

In some example embodiments, the protective cover 202 may be omitted without departing from the scope of this disclosure. For example, the materials 206, 208 may be placed in contact with each other in the cavity of the molding cover 104, where the self-forming foam is formed in direct contact with the compressor 100.

In some example embodiments, at least one of the materials 206, 208 may be a liquid material, and the materials 206, 208 may start chemically reacting with each other to form the self-forming foam 302. For example, the self-forming foam 302 may be a polyurethane foam. To illustrate, the material 206 may include Tertiary Amine(s), and the material 208 may include Polymeric Diphenylmethane Diisocyanate. The amount of the materials 206, 208 that may be needed to form the self-forming foam 302 that provides adequate sound attenuation may vary, for example, depending on the desired sound attenuation level, the size of the compressor 100, etc. as can be understood by those of ordinary skill in the art with the benefit of this disclosure. The size of the molding cover 104 may vary, for example, depending on the size of the compressor 100, the desired sound attenuation level, etc. as can be understood by those of ordinary skill in the art with the benefit of this disclosure.

In some example embodiments, the door 110 is closed after materials 206, 208 are placed in contact with each other or otherwise allowed to start chemically interacting. For example, the door 110 may need to be closed within a few seconds (e.g., 5 seconds) after the materials 206, 208 start undergoing the chemical reaction that produces the self-forming foam 302. By closing the door 110 and pressing on or holding down the molding cover 104, if needed, the self-forming foam 302, as it is being formed, expands to fill or cover spaces, voids, and gaps around the compressor 100 because of the limitation imposed by the molding cover 104 on continued outward expansion. The self-forming foam 302 may be ready within, for example, a few minutes (e.g., 2 minutes) after the materials 206, 208 start chemically interacting to form the self-forming foam 302. The molding cover 104 may be removed to expose the compressor assembly 300 shown in FIG. 3.

In some example embodiments, the ports and electrical connectors of the compressor 100 may be accessed by precisely cutting through the self-forming foam 302. Alternatively, pipes and electrical connections may be added or exposed prior to the self-forming foam 302 being formed, for example, as described with respect to FIGS. 7-9.

The flexibility of the protective cover allows the self-forming form 302, as it is being formed, to easily push the protective cover to reach and fill voids and gaps that may otherwise be left unfilled. By filling spaces, voids, and gaps around the compressor 100, the self-forming foam 302 can provide a significant attenuation of the sound produced by the compressor 100. For example, at 1250 MHz, which is a typical compressor running frequency of a single stage compressor, the compressor sound outside of the compressor assembly 300 may have a sound power level (LwA), for example, that is 15% or more lower than the sound power level of the compressor sound without the self-forming foam 302. The self-forming foam 302 also results in compressor sound reductions at other frequencies, which contributes to lower overall sound produced by the compressor assembly 302. The extent of sound attenuation may be changed by changing the type and/or amounts of the material(s) that are used to form the self-forming foam 302 and other factors as the amount of air introduced during the forming of the self-forming foam 302.

Although the compressor 100 is shown as having a particular shape, the compressor 100 may have a different shape without departing from the scope of this disclosure. Although the molding cover 104 is shown as having a particular shape, the molding cover 104 may have a different shape without departing from the scope of this disclosure. In some alternative embodiments, the opening 106 and the door 110 may have different shapes and sizes than shown without departing from the scope of this disclosure. The opening 106 may be located at a different location in the top wall 108 or in a different wall of the molding cover 104 without departing from the scope of this disclosure. In some example embodiments, the molding cover 104 may include more than one opening without departing from the scope of this disclosure. In some alternative embodiments, the protective cover 202 may have a different shape and size than shown without departing from the scope of this disclosure.

Figure 5:
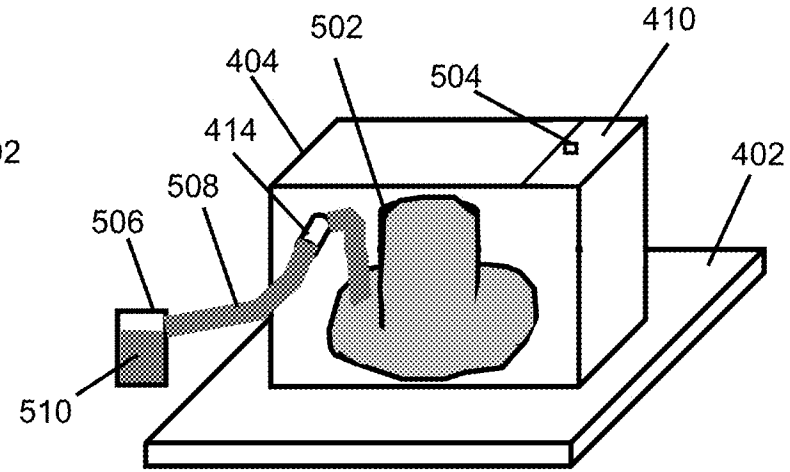
FIG. 5 illustrates a protective cover placed over the compressor of FIG. 4 according to an example embodiment.
Figure 4:
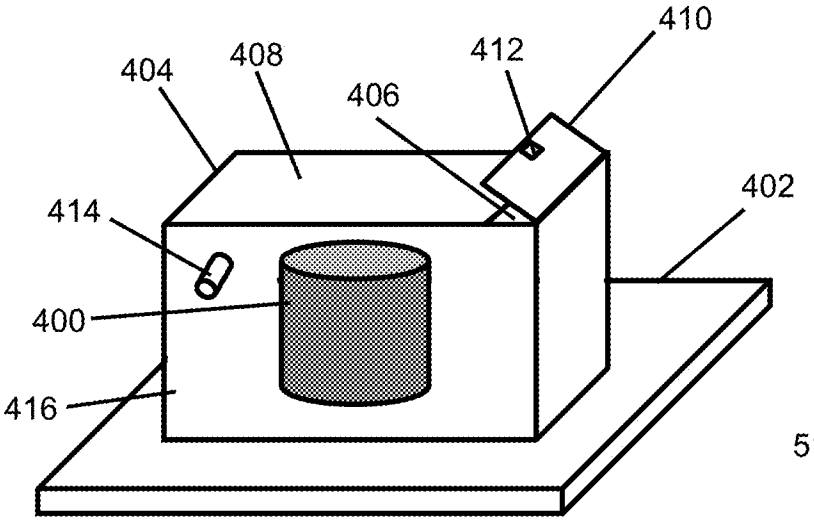
FIG. 4 illustrates a compressor covered by a molding cover according to another example embodiment.
Figure 6:
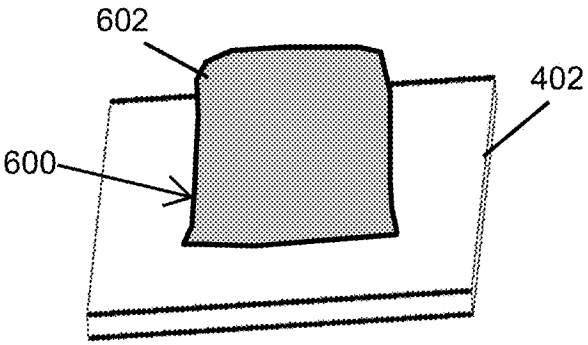
FIG. 6 illustrates a side view of a compressor assembly including a self-forming foam formed around the compressor of FIG. 4 from a liquid foam material placed inside the molding cover according to an example embodiment.

FIG. 4 illustrates a compressor 400 covered by a molding cover 404 according to another example embodiment. FIG. 5 illustrates a protective cover 502 placed over the compressor 400 of FIG. 4 according to an example embodiment. FIG. 6 illustrates a side view of a compressor assembly 600 including a self-forming foam 602 formed around the compressor 400 of FIG. 4 from a liquid foam material placed inside the molding cover according to an example embodiment. In FIGS. 4 and 5, the front-facing wall of the molding cover 404 is shown as a transparent wall to more clearly show the cavity of the molding cover 404.

Referring to FIGS. 4-6, in some example embodiments, the compressor 400 may be placed on a platform 402. For example, the platform 402 may be a base structure of an outdoor air conditioning unit. The compressor 400 of an air conditioning system (e.g., the air condition system shown in FIG. 12) may be positioned in a cavity of the molding cover 404. For example, the molding cover 404 may be placed over the compressor 400, where, for example, the bottom side of the molding cover 404 is at least partially open.

In some example embodiments, the molding cover 404 includes an opening 406 and a door 410 that may be used to cover the opening 406. For example, the opening 406 may be formed on a top wall 408 of the molding cover 404. Alternatively, the opening 406 may be at a different location in the top wall 408 or another wall of the molding cover 404 without departing from the scope of this disclosure. The door 410 may include a latching mechanism 412 for keeping the door 410 latched to the top wall 408.

In some example embodiments, the latching mechanism 412 may be an opening or another structure to interface with a latching structure 504 attached to the top wall 408. The latching mechanism 412 and the latching structure 504 may operate to keep the door 410 latched such that the door closes the opening 406. In some alternative embodiments, the door 410 may be kept latched to the top wall 408 by other means as may be contemplated by those of ordinary skill in the art with the benefit of this disclosure.

In some example embodiments, the compressor 400 may be covered by the protective cover 502 as more clearly shown in FIG. 4. The protective cover 502 protects the compressor 400 from direct contact with the self-forming foam 602 or one or more materials, such as a liquid foam, that may be used to form the self-forming foam 402. For example, the protective cover 302 may be a flexible cover that is placed over the compressor 400, for example, through the opening 406 before the opening is closed by the door 410. Alternatively, the protective cover 502 may be a flexible cover that is placed over the compressor 400 before the compressor 400 is positioned in the cavity of the molding cover 404. In some example embodiments, the protective cover 502 may be made from plastic. The molding cover 404 may be made from a suitable material such as one or more metals, wood, plastic, etc.

In some example embodiments, a liquid foam 510 that is used to form the self-forming foam 602 shown in FIG. 6 is provided into the cavity of the molding cover 404. For example, the liquid foam 510 may be provided into the cavity of the molding cover 104 through an opening/port 414 in a front-facing wall 416 of the molding cover 404. To illustrate, a liquid foam container 506 may be fluidly connected to the opening 414 via a fluid connection 508 (e.g., a flexible hose). For example, the liquid foam container 506 may operate as a pump to pump some of the liquid foam 510 into the cavity of the molding cover 404 through the opening 414. The liquid foam 510 that enters the cavity of the molding cover 404 may be placed at least partially on the protective cover 502. In some alternative embodiments, the liquid foam 510 may be poured or otherwise placed in the cavity of the molding cover 404, for example, through the opening 406.

In some example embodiments, the protective cover 502 may protect the compressor 400 from direct contact with the self-forming foam 602 or the liquid foam 510. For example, the protective cover 502 may be between the compressor 400 and the self-forming foam 602 such that the self-forming foam 602 is not in direct contact with the compressor 400. The protective cover 502 allows, for example, easier removal of the entire or parts of the self-forming foam 602 from the compressor 400 and may provide some protection of the ports of the compressor 400 from direct exposure to the liquid foam 510 and the self-forming foam 602.

In some example embodiments, the protective cover 502 may be omitted without departing from the scope of this disclosure. For example, the liquid foam 510 may be placed (e.g., pumped by the liquid foam container 506) into the cavity of the molding cover 404, where the self-forming foam 602 is formed in direct contact with the compressor 400.

In some example embodiments, the self-forming foam 602 formed from the liquid foam 510 may be a polyurethane foam. The amount of the liquid foam 510 that may be needed to form the self-forming foam 602 that provides adequate sound attenuation may vary, for example, depending on the desired sound attenuation level, the size of the compressor 600, etc. as can be understood by those of ordinary skill in the art with the benefit of this disclosure. The size of the molding cover 404 may vary, for example, depending on the size of the compressor 400, the desired sound attenuation level, etc. as can be understood by those of ordinary skill in the art with the benefit of this disclosure.

In some example embodiments, the door 410 is closed before the liquid foam 510 is provided into the cavity of the molding cover 404. Alternatively, the door 410 may need to be closed within a few seconds after the start of providing the liquid foam 510 into the cavity of the molding cover 404 to form the self-forming foam 602. By closing the door 410 and pressing on or holding down the molding cover 404, if needed, the self-forming foam 602, as it is being formed, expands to fill or cover spaces, voids, and gaps around the compressor 400 because of the limitation imposed by the molding cover 404 on continued outward expansion. The self-forming foam 602 may be ready within, for example, a few minutes after the liquid foam 510 is provided into the cavity of the molding cover 404 to form the self-forming foam 602. The molding cover 404 may be removed to expose the compressor assembly 600 shown in FIG. 6.

In some example embodiments, the ports and electrical connectors of the compressor 400 may be accessed by precisely cutting through the self-forming foam 602. Alternatively, pipes and electrical connections may be added or exposed prior to the self-forming foam 602 being formed, for example, as described with respect to FIGS. 7-9.

The flexibility of the protective cover allows the self-forming form 602, as it is being formed, to easily push the protective cover to reach and fill voids and gaps that may otherwise be left unfilled. By filling spaces, voids, and gaps around the compressor 400, the self-forming foam 602 can provide a significant attenuation of the sound produced by the compressor 400. The extent of sound attenuation provided by the self-forming foam 602 may be changed by changing the type and/or amount of the liquid foam that is used to form the self-forming foam 602 and other factors as the amount of air introduced during the forming of the self-forming foam 602.

Although the compressor 400 is shown as having a particular shape, the compressor 400 may have a different shape without departing from the scope of this disclosure. Although the molding cover 404 is shown as having a particular shape, the molding cover 104 may have a different shape without departing from the scope of this disclosure. In some alternative embodiments, the opening 406 and the door 410 may have different shapes and sizes than shown without departing from the scope of this disclosure. In some alternative embodiments, the opening 414 may have a different shape and size than shown without departing from the scope of this disclosure. The opening 414 may be located at a different location in the top wall 408 or in a different wall of the molding cover 404 without departing from the scope of this disclosure. The opening 406 may be located at a different location in the front-facing wall 416 or in a different wall of the molding cover 404 without departing from the scope of this disclosure. In some example embodiments, the molding cover 404 may include more than one opening without departing from the scope of this disclosure. In some alternative embodiments, the protective cover 502 may have a different shape and size than shown without departing from the scope of this disclosure. In some alternative embodiments, the opening 406 may be omitted without departing from the scope of this disclosure.

FIG. 7 illustrates the compressor 700 covered by a molding cover 704 according to another example embodiment. FIG. 8 illustrates a protective cover 802 placed over the compressor 700 of FIG. 7 according to an example embodiment. FIG. 9 illustrates a side view of a compressor assembly 900 including a self-forming foam 902 formed around the compressor 700 of FIG. 7 from a liquid foam material placed inside the molding cover according to an example embodiment. In FIGS. 7 and 8, the front-facing wall of the molding cover 704 is shown as a transparent wall to more clearly show the cavity of the molding cover 704.

Referring to FIGS. 7-9, in some example embodiments, the compressor 700 may be placed on a platform 702. For example, the platform 702 may be a base structure of an outdoor air conditioning unit. The compressor 700 of an air conditioning system (e.g., the air condition system shown in FIG. 12) may be positioned in a cavity of the molding cover 704. For example, the molding cover 704 may be placed over the compressor 700, where, for example, the bottom side of the molding cover 704 is at least partially open.

In some example embodiments, the molding cover 704 includes an opening 706 and a door 710 that may be used to cover the opening 706. For example, the opening 706 may be formed on a top wall 708 of the molding cover 704. Alternatively, the opening 706 may be at a different location in the top wall 708 or another wall of the molding cover 704 without departing from the scope of this disclosure. The door 710 may include a latching mechanism 712 for keeping the door 710 latched to the top wall 708.

In some example embodiments, the latching mechanism 712 may be an opening or another structure to interface with a latching structure 804 attached to the top wall 708. The latching mechanism 712 and the latching structure 804 may operate to keep the door 710 latched such that the door closes the opening 706. In some alternative embodiments, the door 710 may be kept latched to the top wall 708 by other means as may be contemplated by those of ordinary skill in the art with the benefit of this disclosure.

In some example embodiments, the compressor 700 may be covered by the protective cover 802 as more clearly shown in FIG. 7. The protective cover 802 protects the compressor 700 from direct contact with the self-forming foam 902 or one or more materials, such as a liquid foam 510, that may be used to form the self-forming foam 702. For example, the protective cover 302 may be a flexible cover that is placed over the compressor 700, for example, through the opening 706 before the opening is closed by the door 710. Alternatively, the protective cover 802 may be a flexible cover that is placed over the compressor 700 before the compressor 700 is positioned in the cavity of the molding cover 704. In some example embodiments, the protective cover 802 may be made from plastic. The molding cover 704 may be made from a suitable material such as one or more metals, wood, plastic, etc.

In some example embodiments, pipes 718 may already be attached to the ports, such as the discharge and suction ports, of the compressor 700. For example, the compressor 700 may be an existing compressor of an outdoor unit of an air conditioner system or a heat pump system that is already in use. Alternatively, the pipes 718 may be attached to the ports of the compressor 700 prior to forming the self-forming foam 902 shown in FIG. 9. In some example embodiments, the pipes 718 may extend out of the molding cover 704 through respective openings, such as the opening 722, in a wall of the molding cover 704. As shown in FIG. 8, the protective cover 802 covers portions of the pipes 718.

In some example embodiments, one or more electrical wires 720 may already be attached to one or more electrical connectors of the compressor 700. For example, the compressor 700 may be an existing compressor of an outdoor unit of an air conditioner system or a heat pump system that is already in use. Alternatively, the electrical wires 720 may be attached to the connectors of the compressor 700 prior to forming the self-forming foam 902 shown in FIG. 9. In some example embodiments, the electrical wires 720 may extend out of the molding cover 704 through an opening 724 or another opening in a wall of the molding cover 704. As shown in FIG. 8, the protective cover 802 covers portions of the wires 720.

In some example embodiments, the liquid foam 510 that is used to form the self-forming foam 902 shown in FIG. 9 is provided into the cavity of the molding cover 704. For example, the liquid foam 510 may be provided into the cavity of the molding cover 104 through an opening/port 714 in a front-facing wall 716 of the molding cover 704. To illustrate, the liquid foam container 506 may be fluidly connected to the opening 714 via the fluid connection 508 (e.g., a flexible hose). For example, the liquid foam container 506 may operate as a pump to pump some of the liquid foam 510 into the cavity of the molding cover 704 through the opening 714. The liquid foam 510 that enters the cavity of the molding cover 704 may be placed at least partially on the protective cover 802. In some alternative embodiments, the liquid foam 510 may be poured or otherwise placed in the cavity of the molding cover 704, for example, through the opening 706.

In some example embodiments, the protective cover 802 may protect the compressor 700 from direct contact with the self-forming foam 902 or the liquid foam 510. For example, the protective cover 802 may be between the compressor 700 and the self-forming foam 902 such that the self-forming foam 902 is not in direct contact with the compressor 700. The protective cover 802 allows, for example, easier removal of the entire or parts of the self-forming foam 902 from the compressor 700.

In some example embodiments, the protective cover 802 may be omitted without departing from the scope of this disclosure. For example, the liquid foam 510 may be placed (e.g., pumped by the liquid foam container 506) into the cavity of the molding cover 704, where the self-forming foam 902 is formed in direct contact with the compressor 700.

In some example embodiments, the self-forming foam 902 formed from the liquid foam 510 may be a polyurethane foam. The amount of the liquid foam 510 that may be needed to form the self-forming foam 902 that provides adequate sound attenuation may vary, for example, depending on the desired sound attenuation level, the size of the compressor 900, etc. as can be understood by those of ordinary skill in the art with the benefit of this disclosure. The size of the molding cover 704 may vary, for example, depending on the size of the compressor 700, the desired sound attenuation level, etc. as can be understood by those of ordinary skill in the art with the benefit of this disclosure.

In some example embodiments, the door 710 is closed before the liquid foam 510 is provided into the cavity of the molding cover 704. Alternatively, the door 710 may need to be closed within a few seconds after the start of providing the liquid foam 510 into the cavity of the molding cover 704 to form the self-forming foam 902. By closing the door 710 and pressing on or holding down the molding cover 704, if needed, the self-forming foam 902, as it is being formed, expands to fill or cover spaces, voids, and gaps around the compressor 700 because of the limitation imposed by the molding cover 704 on continued outward expansion. The self-forming foam 902 may be ready within, for example, a few minutes after the liquid foam 510 is provided into the cavity of the molding cover 704 to form the self-forming foam 902. The molding cover 704 may be removed to expose the compressor assembly 900 shown in FIG. 9.

The flexibility of the protective cover allows the self-forming form 902, as it is being formed, to easily push the protective cover to reach and fill voids and gaps that may otherwise be left unfilled. By filling spaces, voids, and gaps around the compressor 700, the self-forming foam 902 can provide a significant attenuation of the sound produced by the compressor 700. The extent of sound attenuation provided by the self-forming foam 902 may be changed by changing the type and/or amount of the liquid foam that is used to form the self-forming foam 902 and other factors as the amount of air introduced during the forming of the self-forming foam 902.

Although FIGS. 7-9 are described with respect to a liquid foam being used to form the self-forming form 902, in alternative embodiments, other materials, such as the materials 206, 208, may be used as described above with respect to FIGS. 1-3. Although the compressor 700 is shown as having a particular shape, the compressor 700 may have a different shape without departing from the scope of this disclosure. Although the molding cover 704 is shown as having a particular shape, the molding cover 104 may have a different shape without departing from the scope of this disclosure. In some alternative embodiments, the opening 706 and the door 710 may have different shapes and sizes than shown without departing from the scope of this disclosure. In some alternative embodiments, the opening 714 may have a different shape and size than shown without departing from the scope of this disclosure. The opening 714 may be located at a different location in the top wall 708 or in a different wall of the molding cover 704 without departing from the scope of this disclosure. The opening 706 may be located at a different location in the front-facing wall 716 or in a different wall of the molding cover 704 without departing from the scope of this disclosure. In some example embodiments, the molding cover 704 may include more than one opening without departing from the scope of this disclosure. In some alternative embodiments, the protective cover 802 may have a different shape and size than shown without departing from the scope of this disclosure. In some alternative embodiments, the opening 706 may be omitted without departing from the scope of this disclosure. In some example embodiments, the compressor 700 corresponds to the compressors 100, 400 described above. In some example embodiments, the molding cover 704 corresponds to the molding covers 104, 404 described above. In some example embodiments, the protective cover 802 corresponds to the protective covers 202, 402 described above.

Figure 10:
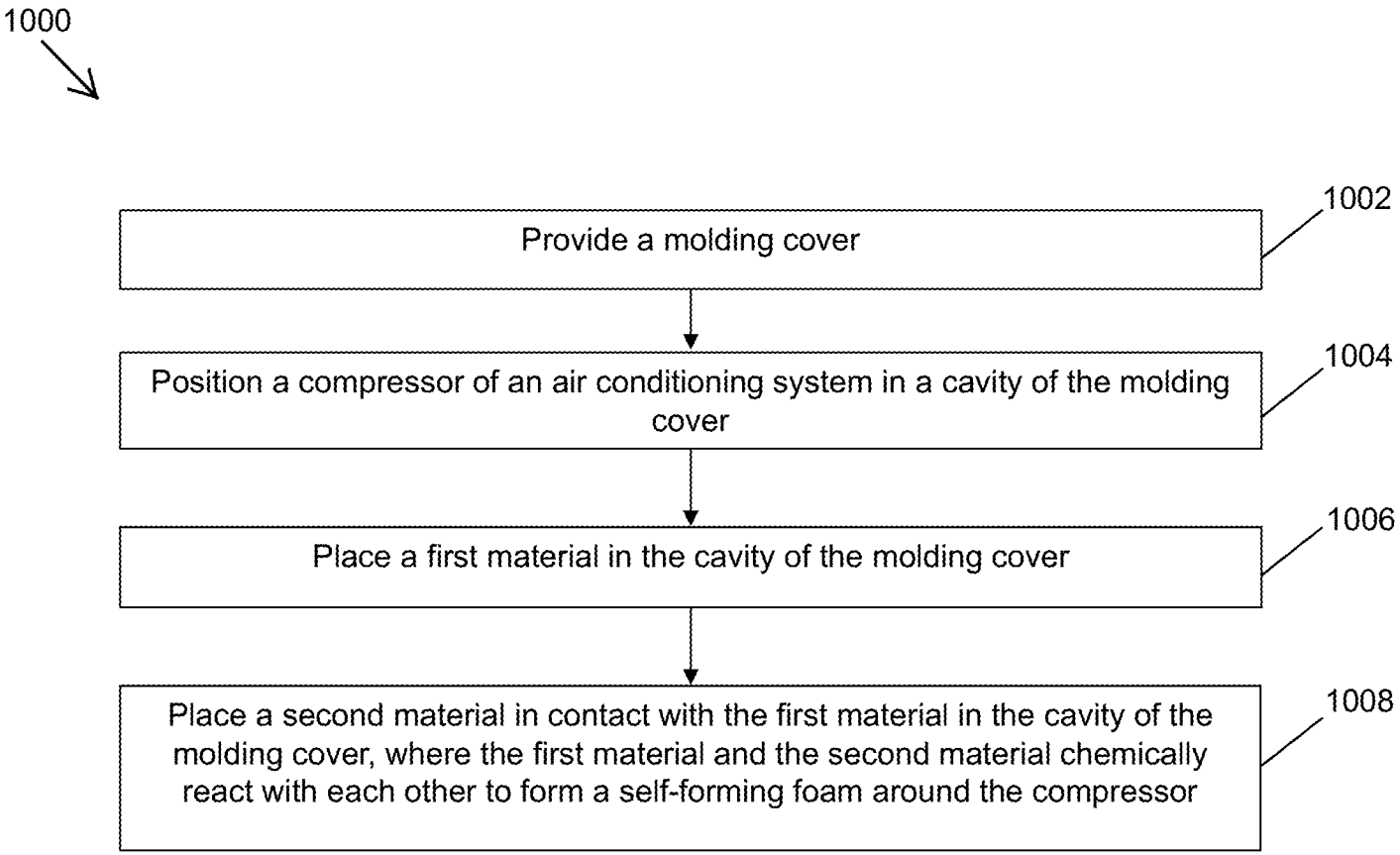
FIG. 10 illustrates a flowchart of a method of forming a self-forming foam around a compressor according to an example embodiment.

FIG. 10 illustrates a flowchart of a method 1000 of forming a self-forming foam around a compressor according to an example embodiment. Referring to FIGS. 1-3 and 10, in some example embodiments, the method 1000 includes, at step 1002, providing a molding cover such as the molding cover 104. At step 1004, the method 1000 may include positioning a compressor of an air conditioning system in a cavity of the molding cover. For example, the compressor 100 may be positioned in the cavity of the molding cover 104, for example, by placing the molding cover 104 over the compressor 100.

In some example embodiments, at step 1006, the method 1000 may include placing a first material in the cavity of the molding cover, such as the cavity of the molding cover 104. At step 1008, the method 1000 may include placing a second material in contact with the first material in the cavity of the molding cover, such as the cavity of the molding cover 104. The first material, such as the material 206 shown in FIG. 2, may be placed in the cavity of the molding cover, for example, by pouring in the first material through an opening, such as the opening 106 of the molding cover 104. The second material, such as the material 208 shown in FIG. 2, may be placed in contact with the first material by also pouring in the second material into the cavity of the molding cover. Alternatively, the containers of the materials 206, 208 may be opened or otherwise intentionally breached so that the materials 206, 208 start chemically interacting with each other. The first material and the second material chemically react with each other to form a self-forming foam around the compressor. For example, at least one of the first material and the second material may be a liquid material, and the first and second material may react with each other to form the self-forming foam 302, which may be a polyurethane foam. To illustrate, the first material may include tertiary amine(s), and the second material may include polymeric diphenylmethane diisocyanate.

In some example embodiments, the method 1000 includes covering the compressor by a protective cover. For example, the compressor 100 may be covered by the protective cover 202 as described above. To illustrate, the compressor 100 may be covered by the protective cover 202 before the first and second materials are placed in the cavity of the molding cover 104 or before the self-forming foam is formed. In some alternative embodiments, the first material and the second material may be inside the protective cover separated from the compressor by the protective cover, where the compressor is covered by the protective cover while the first material and the second material are inside the protective cover. For example, the protective cover may include compartments that keep the first material and the second material separated from each other until the separation is removed to allow the first material and the second material to interact chemically to form the self-forming foam.

When a protective cover, such as the protective cover 202 is used, the protective cover is between the compressor and the self-forming foam formed from the interaction of the first and second materials that are placed in the cavity of the molding cover. The protective cover may be a flexible cover, such a cover made from plastic. The flexibility of the protective cover allows the self-forming form, as it is being formed, to easily push the protective cover to reach and fill voids and gaps that may otherwise be left unfilled.

In some example embodiments, one or more pipes may be attached to respective ports of the compressor before placing the second material in contact with the first material to form the self-forming foam. For example, the compressor may be a new compressor, and tubing (e.g., the pipes 718 shown in FIGS. 7-9) may be added to the compressor, such as the compressor 100 before the self-forming foam is formed. Alternatively, the compressor may be an existing compressor that already has connected pipes.

In some example embodiments, one or more steps of the method 1000 described above may be omitted or performed in a different order than described. In some example embodiments, the method 1000 may include other steps. In some example embodiments, some of the steps of the method 1000 may be combined without departing from the scope of this disclosure.

Figure 11:
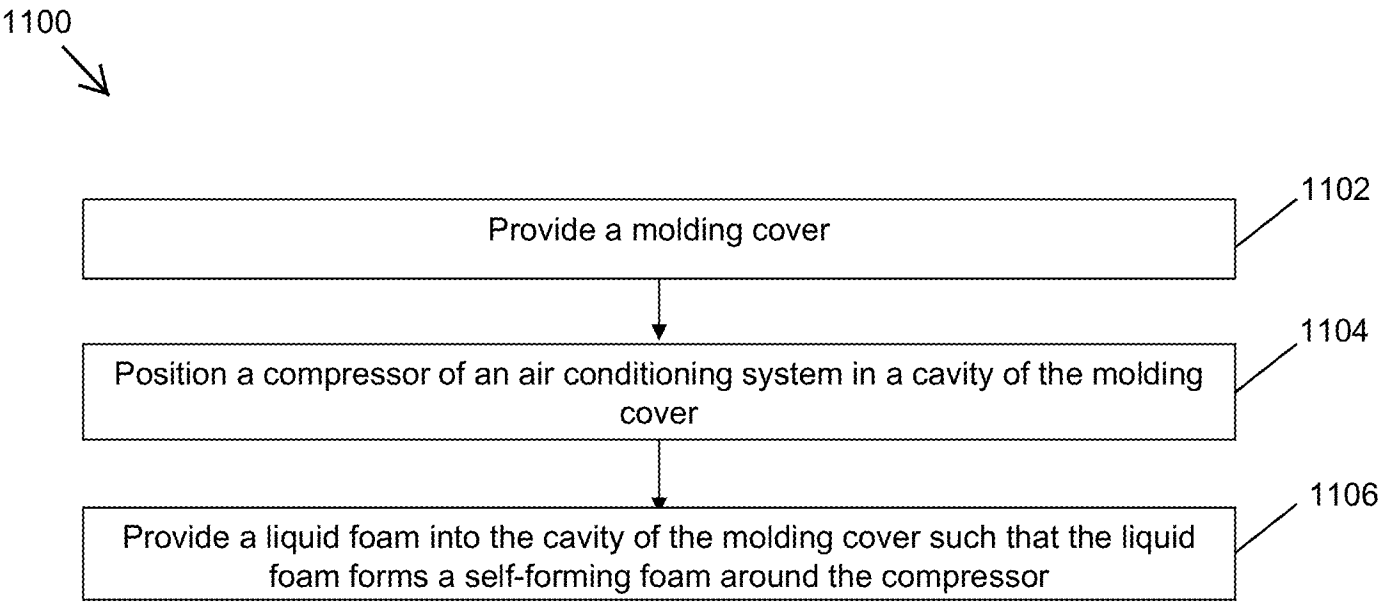
FIG. 11 illustrates a flowchart of a method of forming a self-forming foam around a compressor according to an example embodiment.

FIG. 11 illustrates a flowchart of a method of forming a self-forming foam around a compressor according to an example embodiment. Referring to FIGS. 4-9 and 11, in some example embodiments, the method 1100 includes, at step 1102, providing a molding cover such as the molding cover 404, 704. At step 1104, the method 1100 may include positioning a compressor of an air conditioning system in a cavity of the molding cover. For example, the compressor 400 may be positioned in the cavity of the molding cover 404, for example, by placing the molding cover 404 over the compressor 400. As another example, the compressor 700 may be positioned in the cavity of the molding cover 704, for example, by placing the molding cover 704 over the compressor 700.

In some example embodiments, at step 1106, the method 1000 may include providing a liquid foam into the cavity of the molding cover, where the liquid foam forms a self-forming foam around the compressor. For example, a liquid foam may be provided into the cavity of the molding cover 404, 704 via a respective opening/port 414, 714, and the liquid foam may form a self-forming foam that covers the compressor 400, 700, respectively. To illustrate, the liquid foam may be pumped into the cavity of the molding cover.

In some example embodiments, the method 1100 includes covering the compressor by a protective cover such that the protective cover is between the compressor and the self-forming foam that is formed from the liquid foam. For example, the compressor 400, 700 may be covered by the protective cover 502, 802, respectively, as described above. To illustrate, the compressor 400 may be covered by the protective cover 502 before the liquid foam is provided into the cavity of the molding cover 404, and the compressor 700 may be covered by the protective cover 802 before the liquid foam is provided into the cavity of the molding cover 704.

When a protective cover, such as the protective cover 502, 802, is used, the protective cover is between the compressor and the self-forming foam formed from the liquid foam provided into the cavity of the molding cover through the opening/port 414, 714 or openings 406, 706. The protective cover may be a flexible cover, such a cover made from plastic. The flexibility of the protective cover allows the self-forming form, as it is being formed, to easily push the protective cover to reach and fill voids and gaps that may otherwise be left unfilled.

In some example embodiments, one or more pipes may be attached to respective ports of the compressor before placing the second material in contact with the first material to form the self-forming foam. For example, the compressor 700 may be a new compressor, and tubing, such as the pipes 718, may be added to the compressor 700 before the self-forming foam is formed. Alternatively, the compressor may be an existing compressor that already has connected pipes.

In some example embodiments, one or more steps of the method 1100 described above may be omitted or performed in a different order than described. In some example embodiments, the method 1100 may include other steps. In some example embodiments, some of the steps of the method 1100 may be combined without departing from the scope of this disclosure.

Figure 12:
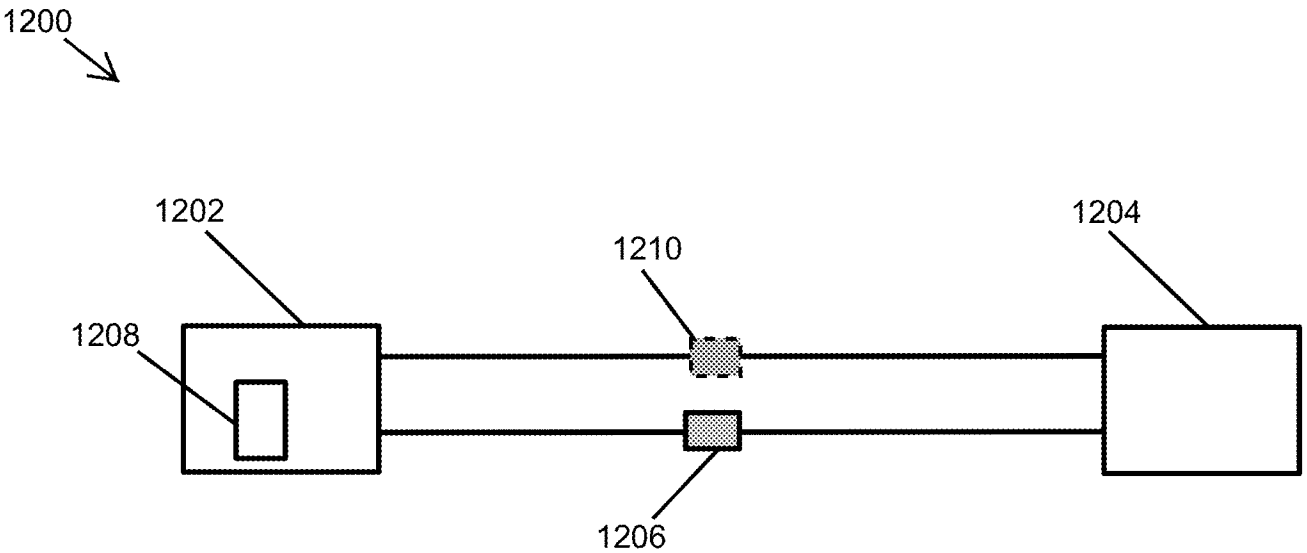
FIG. 12 illustrates an air conditioning system including a compressor assembly corresponding to the compressor assemblies of FIGS. 3, 6, and 9 according to an example embodiment.

FIG. 12 illustrates an air conditioning system 1200 including a compressor assembly 1208 corresponding to each of the compressor assemblies 302, 602, 902 of FIGS. 3, 6, and 9 according to an example embodiment. For example, the air conditioning system 1200 may include a self-formed foam, such as the self-formed foam 302, 602, 902, formed around a compressor, such as the compressor 100, 300, 700.

In some example embodiments, the air conditioning system 1200 may be an air conditioner system or heat pump system. In some example embodiments, the air conditioning system 1200 includes an outdoor unit 1202, an indoor unit 1204, and an expansion valve 1206. In some example embodiments, the air conditioning system 1200 may also include other equipment 1210, such as a reversing valve.

In some example embodiments, the outdoor unit 1202 includes the compressor assembly 1208 as well as other components (not shown) such as a fan, coil, etc. The indoor unit 1204 also includes components such as a coil that may serve as an evaporator or a condenser. During operations of the air conditioning system 1200, the outdoor unit 1202 produces a significantly lower sound than a typical outdoor unit that includes a compressor that is not covered by the self-forming foam, such as the self-formed foam 302, 602, 902. In particular, the sound compressor assembly 1208 produces a significantly lower sound than a typical outdoor unit that is not covered by the self-forming foam, such as the self-formed foam 302, 602, 902. For example, the sound compressor assembly 1208 may result in greater than a 15% sound reduction at 1250 MHz, which is a frequency associated with the sound commonly produced by air conditioning system compressors. The self-forming foam of the compressor assembly 1208 provides a significant sound reduction at reasonably low cost and low complexity.

In some alternative embodiments, the air conditioning system 1200 may include other components than shown without departing from the scope of this disclosure. In some alternative embodiments, the air conditioning system 1200 may include other connections than shown without departing from the scope of this disclosure.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A method for forming a sound-attenuating structure around a compressor, the method comprising:

covering the compressor with a flexible protective cover such that at least some of an inner surface of the flexible protective cover abuts the compressor;

depositing a plurality of materials proximate an outer surface of the flexible protective cover, at least some of the plurality of materials being configured to chemically react to create a self-forming foam that abuts at least some of the flexible protective cover to thereby create the sound-attenuating structure around the compressor, wherein the plurality of materials are deposited in a first compartment formed by the flexible protective cover and a second compartment formed by the flexible protective cover, such that two discrete portions of self-forming foam are created on the outer surface of the flexible protective cover instead of the inner surface of the flexible protective cover, wherein the flexible protective cover extends outward with respect to the compressor to form the first compartment and second compartment; and forming, after the self-forming foam is created, an aperture in the self-forming foam to access a port of the compressor.

2. The method of claim 1 further comprising:

positioning a molding cover at least partially around the compressor such that the compressor and the flexible protective cover are located in a cavity formed at least in part by the molding cover, wherein depositing the plurality of materials comprises placing the plurality of materials into the cavity of the molding cover.

3. The method of claim 2, wherein the molding cover includes an opening for placing the plurality of materials into the cavity of the molding cover.

4. The method of claim 2 further comprising:

removing the molding cover from the compressor after creating the sound-attenuating structure around the compressor.

5. The method of claim 1, wherein the self-forming foam is configured to expand, thereby pushing the flexible protective cover inwardly toward the compressor to reduce voids located between the flexible protective cover and the compressor.

6. The method of claim 1, wherein the flexible protective cover is configured to separate the self-forming foam from the compressor.

7. The method of claim 6, wherein the flexible protective cover is configured to enable the sound-attenuating structure to be removable from the compressor.

8. The method of claim 1 further comprising:

attaching one or more pipes to one or more respective ports of the compressor before depositing at least some of the plurality of materials proximate the outer surface of the flexible protective cover.

9. The method of claim 1, wherein the self-forming foam comprises a polyurethane foam, and wherein the plurality of materials includes tertiary amine and polymeric diphenylmethane diisocyanate.

10. The method of claim 1, wherein the flexible protective cover extends outward in a plurality of directions with respect to the compressor.

11. A compressor assembly, the compressor assembly comprising:

a compressor; and a sound-attenuating structure configured to attenuate a sound produced by the compressor, the sound-attenuating structure comprising:

a flexible protective cover covering the compressor; and a self-forming foam formed around the compressor, the self-forming foam being formed by chemical reaction of a plurality of materials placed around an outside of the flexible protective cover, the plurality of materials substantially surrounding the flexible protective cover, the plurality of materials being configured to chemically react to form the self-forming foam, wherein the flexible protective cover separates the self-forming foam from the compressor, and wherein the plurality of materials are deposited in a first compartment formed by the flexible protective cover and a second compartment formed by the flexible protective cover, such that two discrete portions of self-forming foam are formed on an outer surface of the flexible protective cover instead of an inner surface of the flexible protective cover, wherein the flexible protective cover extends outward with respect to the compressor to form the first compartment and second compartment.

12. The compressor assembly of claim 11, wherein a pipe is connected to a port of the compressor via an aperture in the self-forming foam.

13. The compressor assembly of claim 11, wherein the self-forming foam comprises a polyurethane foam.

* * * * *